US009114642B2

(12) United States Patent
Satake

(10) Patent No.: US 9,114,642 B2
(45) Date of Patent: Aug. 25, 2015

(54) CONVEYOR DEVICE AND IMAGE FORMING APPARATUS

(71) Applicant: KYOCERA DOCUMENT SOLUTIONS INC., Osaka (JP)

(72) Inventor: Kenichi Satake, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/141,283

(22) Filed: Dec. 26, 2013

(65) Prior Publication Data

US 2014/0184715 A1 Jul. 3, 2014

(30) Foreign Application Priority Data

Dec. 27, 2012 (JP) ..... 2012-285244

(51) Int. Cl.
*B41J 2/01* (2006.01)
*B41J 11/00* (2006.01)
*B65H 5/22* (2006.01)

(52) U.S. Cl.
CPC ..... *B41J 11/007* (2013.01); *B41J 11/0085* (2013.01); *B65H 5/224* (2013.01); *B65H 2406/3223* (2013.01); *B65H 2406/361* (2013.01); *B65H 2406/3622* (2013.01)

(58) Field of Classification Search
CPC ..... B41J 11/0085
See application file for complete search history.

(56) References Cited

U.S. PATENT DOCUMENTS

| | | | | |
|---|---|---|---|---|
| 6,729,720 | B2 | 5/2004 | Miki et al. | |
| 8,287,084 | B2 * | 10/2012 | Ito | 347/23 |
| 2002/0167578 | A1 | 11/2002 | Miki et al. | |
| 2009/0244244 | A1 * | 10/2009 | Sawada | 347/104 |
| 2010/0171804 | A1 * | 7/2010 | Takahashi et al. | 347/104 |
| 2010/0253720 | A1 | 10/2010 | Takahashi et al. | |

FOREIGN PATENT DOCUMENTS

| | | | |
|---|---|---|---|
| JP | 2001-171188 | A | 6/2001 |
| JP | 2005-170547 | A | 6/2005 |
| JP | 2007-076175 | A | 3/2007 |
| JP | 2010-280149 | A | 12/2010 |

* cited by examiner

*Primary Examiner* — Shelby Fidler
*Assistant Examiner* — Tracey McMillion
(74) *Attorney, Agent, or Firm* — Studebaker & Brackett PC

(57) ABSTRACT

A plurality of suction holes are formed in a conveyance belt of a conveyor device. A suction unit is arranged on one of surfaces of the conveyance belt. The suction unit includes a unit case in which cells adjacent in a paper conveyance direction are formed and defined by a partition wall extending in a width direction of the conveyance belt, a ceiling wall interposed between the unit case and the conveyance belt, and a fan provided in each of the adjacent cells. The ceiling wall includes a slit group which communicates the respective adjacent cells with the plurality of suction holes. The slit group includes a plurality of slits formed across the partition wall. The plurality of slits formed across the partition wall include slits in communication with one of the adjacent cells and slits in communication with the other of the adjacent cells.

17 Claims, 5 Drawing Sheets

CONVEYOR DEVICE AND IMAGE FORMING APPARATUS

INCORPORATION BY REFERENCE

The present application claims priority under 35 U.S.C. §119 to Japanese Patent Application No. 2012-285244, filed Dec. 27, 2012. The contents of this application are incorporated herein by reference in their entirety.

BACKGROUND

The present disclosure relates to conveyor devices included in image forming apparatuses such as printers, copiers, multifunction peripherals, etc. and image forming apparatuses.

Inkjet recording apparatuses that form an image on a recording medium such as paper, etc. by ejecting ink droplets from a plurality of nozzles are widely used in printers, copiers, multifunction peripherals, etc. because of its compactness, inexpensiveness, low operating noise, etc.

In an inkjet recording apparatus, a conveyance belt conveys a recording medium such as copy paper, etc. A recording head ejects ink droplets to the recording medium to form an image on the recording medium. The recording head is arranged at a distance of about 1.0-1.5 mm from a recording medium so as not to come in contact with the recording medium.

In the inkjet recording apparatus having such a structure, when a recording medium comes off from the conveyance belt by sag of the recording medium, wind pressure caused due to the recording medium passing under the recording head, or the like, the distance between the recording medium and the recording head varies. This may impair image quality.

In order to address the above described problem, a conveyor device that sucks a recording medium on the conveyance belt is proposed. Some conveyor devices include a conveyance belt driven in a conveyance direction of a recording medium and a suction unit arranged on one of the surfaces of the conveyance belt. A plurality of suction holes are formed in the conveyance belt.

The suction unit includes a fan case and a fan provided in the fan case. Holes or slits are formed in a ceiling wall of the fan case so as to communicate the interior of the fan case with the suction holes of the conveyance belt.

When the fan is driven with the recording medium loaded on the other surface of the conveyance belt, negative pressure is generated in the fan case to act on the recording medium through the suction holes of the conveyance belt. Thus, the recording medium is sucked on the conveyance belt.

SUMMARY

In the first aspect of the present disclosure, a conveyor device which conveys a recording medium includes: a conveyance belt in which a plurality of suction holes are formed and which is driven in a conveyance direction of the recording medium; and a suction unit arranged on one of surfaces of the conveyance belt and configured to suck the recording medium on the other surface of the conveyance belt through the plurality of suction holes. The suction unit includes: a unit case in which cells adjacent in the conveyance direction of the recording medium are formed and defined by a partition wall extending in a width direction of the conveyance belt; a ceiling wall interposed between the unit case and the conveyance belt; and a suction section provided in each of the adjacent cells and configured to generate negative pressure in an interior of the cell. The ceiling wall includes a slit group which communicates the respective adjacent cells with the plurality of suction holes. The slit group includes a plurality of slits formed across the partition wall. The plurality of slits include slits in communication with one of the adjacent cells and slits in communication with the other of the adjacent cells.

Further, in the second aspect of the present disclosure, an image forming apparatus includes: a conveyor device configured to convey a recording medium; and an image forming section configured to form an image on the recording medium. The conveyor device includes: a conveyance belt in which a plurality of suction holes are formed and which is driven in a conveyance direction of the recording medium; and a suction unit arranged on one of surfaces of the conveyance belt and configured to suck the recording medium on the other surface of the conveyance belt through the plurality of suction holes. The suction unit includes: a unit case in which cells adjacent in the conveyance direction of the recording medium are formed and defined by a partition wall extending in a width direction of the conveyance belt; a ceiling wall interposed between the unit case and the conveyance belt; and a suction section provided in each of the adjacent cells and configured to generate negative pressure in an interior of the cell. The ceiling wall includes a slit group which communicates the respective adjacent cells with the plurality of suction holes. The slit group includes a plurality of slits formed across the partition wall. The plurality of slits include slits in communication with one of the adjacent cells and slits in communication with the other of the adjacent cells.

DETAILED DESCRIPTION

Figure 1:
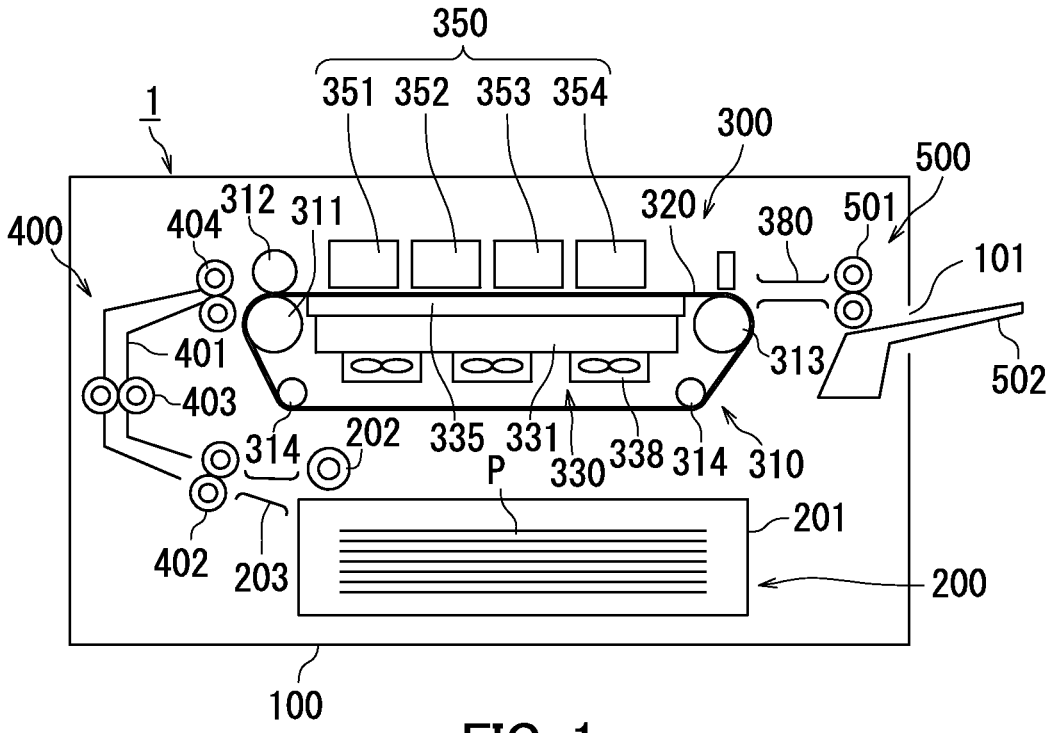
FIG. 1 is a schematic illustration showing a general configuration of an inkjet recording apparatus including a conveyor device according to the first embodiment of the present disclosure.

Embodiments according to the present disclosure will be described below with reference to the accompanying drawings. FIG. 1 is a schematic illustration showing a general configuration of an inkjet recording apparatus 1 including a conveyor device according to the first embodiment of the present disclosure.

The inkjet recording apparatus 1 includes a device casing 100, a paper feed section 200 arranged in the lower part of the device casing 100, an image forming section 300 employing an inkjet recording method and arranged above the paper feed section 200, a paper conveyance section 400 arranged on one side of the image forming section 300, and a paper ejection section 500 arranged on the other side of the image forming section 300.

The paper feed section 200 includes a paper feed cassette 201 detachably mounted in the device casing 100, a paper feed roller 202, and a guide plate 203. The paper feed roller 202 is arranged above the paper feed cassette 201 on one side thereof. The guide plate 203 is arranged between the paper feed roller 202 and the paper conveyance section 400.

Plural sheets of paper P are accommodated in the paper feed cassette 201 in a layered manner. The paper feed roller 202 takes out paper P in the paper feed cassette 201 on a paper-by-paper basis. The guide plate 203 guides the paper P taken out by the paper feed roller 202 to the paper conveyance section 400.

The paper conveyance section 400 includes a substantially C-shaped paper conveyance path 401, a first conveyance roller pair 402 provided at the inlet of the paper conveyance path 401, a second conveyance roller pair 403 provided in the middle of the paper conveyance path 401, and a registration roller pair 404 provided at the outlet of the paper conveyance path 401.

The first conveyance roller pair 402 sandwiches paper P fed from the paper feed section 200 and sends out the paper P to the paper conveyance path 401. The second conveyance roller pair 403 sandwiches the paper P sent out by the first conveyance roller pair 402 and conveys the paper P in a conveyance direction.

The registration roller pair 404 corrects skew of the paper P conveyed by the second conveyance roller pair 403. Then, the registration roller pair 404 temporarily stops the paper P in order to synchronize conveyance of the paper P with printing on the paper P and then sends out the paper P to the image forming section 300 with timing of printing.

The image forming section 300 includes a conveyor device 310, a recording head 350 arranged above the conveyor device 310, and a conveyance guide 380 arranged downstream of the conveyor device 310 in the conveyance direction of the paper P. It is noted that the image forming section 300 may include a dryer to dry ink droplets ejected from the recording head 350 onto the paper P.

The conveyor device 310 includes a support roller 311, a paper retention roller 312, a drive roller 313, a pair of tension rollers 314, an endless conveyance belt 320, and a suction unit 330. The conveyance belt 320 is wound between the support roller 311, the drive roller 313, and the pair of tension rollers 314.

The paper retention roller 312 is arranged above the support roller 311 to sandwich paper P between itself and the support roller 311 and send out the paper P onto the conveyance belt 320. The drive roller 313 is arranged at a distance from the support roller 311 in the conveyance direction of the paper P. A motor (not shown) drives and rotates the drive roller 313 to rotate the conveyance belt 320 in the clockwise direction. The pair of respective tension rollers 314 is arranged below the support roller 311 and the drive roller 313 between the support roller 311 and the drive roller 313 and applies tension to the conveyance belt 320 so as to prevent the conveyance belt 320 from sagging.

The recording head 350 is made up of four line heads 351, 352, 353, and 354 arranged side by side from the upstream side to the downstream side of the conveyance direction of paper P. Each of the line heads 351, 352, 353, and 354 includes a plurality of nozzles (not shown) arranged in the width direction of the conveyance belt 320. The recording head 350 is called a line type recording head.

Each of the plurality of nozzles of the line head 351 is in communication with a pressurizing chamber (not shown) formed in the line head 351. The pressurizing chamber is in communication with an ink chamber formed in the line head 351. Further, the ink chamber is connected to and in communication with a black (K) ink tank (not shown) through an ink supply tube (not shown).

Each of the plurality of nozzles of the line head 352 is in communication with a pressurizing chamber (not shown) formed in the line head 352. The pressurizing chamber is in communication with an ink chamber formed in the line head 352. Further, the ink chamber is connected to and in communication with a cyan (C) ink tank (not shown) through an ink supply tube (not shown).

Each of the plurality of nozzles of the line head 353 is in communication with a pressurizing chamber (not shown) formed in the line head 353. The pressurizing chamber is in communication with an ink chamber formed in the line head 353. Further, the ink chamber is connected to and in communication with a magenta (M) ink tank (not shown) through an ink supply tube (not shown).

Each of the plurality of nozzles of the line head 354 is in communication with a pressurizing chamber (not shown) formed in the line head 354. The pressurizing chamber is in communication with an ink chamber formed in the line head 354. Further, the ink chamber is connected to and in communication with a yellow (Y) ink tank (not shown) through an ink supply tube (not shown).

The suction unit 330 is arranged on one of the surfaces of the conveyance belt 320 to face the recording head 350 with the conveyance belt 320 interposed therebetween. The present embodiment shows the case where the suction unit 330 is arranged on the reverse surface of part of the conveyance belt 320 which is located on the upper side of the conveyance belt 320. The suction unit 330 includes a fan case 331 as a unit case, a ceiling wall 335 covering a top opening of the fan case 331, and a plurality of fans 338 provided in the fan case 331. The fans 338 each function as a suction section in the present disclosure.

The conveyance guide 380 guides paper P ejected from the conveyance belt 320 to the paper ejection section 500.

The paper ejection section 500 includes an ejection roller pair 501 and an exit tray 502. The exit tray 502 is fixed to the device casing 100 so as to protrude outside an exit port 101 formed in the device casing 100.

Paper P which has passed through the conveyance guide 380 is sent out toward the exit port 101 by the ejection roller pair 501 and is guided to the exit tray 502 to be ejected outside the device casing 100 through the exit port 101.

Figure 2:
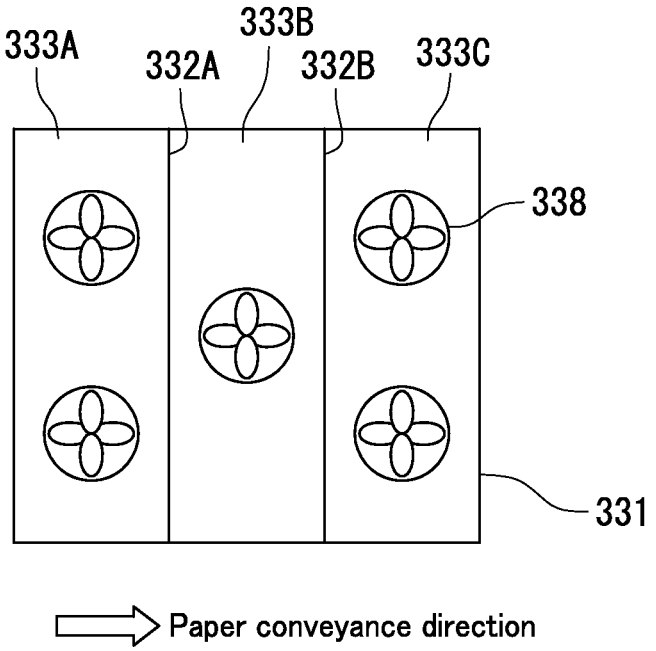
FIG. 2 is a plan view showing a state of an interior of a fan case shown in FIG. 1.

FIG. 2 is a plan view showing a state of the interior of the fan case 331 shown in FIG. 1.

The fan case 331 has a bottomed cylindrical box shape with its top opened. Three cells 333A, 333B, and 333C, which are the same in shape and size, are formed and defined in the interior of the fan case 331 by a pair of partition walls 332A and 332B extending in the width direction of the conveyance belt 320 (direction in parallel with the one surface of the conveyance belt 320 and orthogonal to the conveyance direction of paper P). The three cells 333A, 333B, and 333C are adjacently arranged side by side in the conveyance direction of the paper P. The cell 333A is located the most upstream in the conveyance direction of the paper P. The cell 333C is located the most downstream in the conveyance direction of the paper P. The cell 333B is located between the cells 333A and 333C.

Fan(s) 338 is/are provided in each of the cells 333A, 333B, and 333C. Two fans 338 are provided in each of the cells 333A and 333C, while one fan 338 is provided in the cell 333B. As shown in FIG. 1, the fans 338 are provided in the cells 333A to 333C so that the lower portion of each of the fans 338 protrudes downward from the fan case 331. Each of the fans 338 is connected to a power source (not shown).

Figure 3:
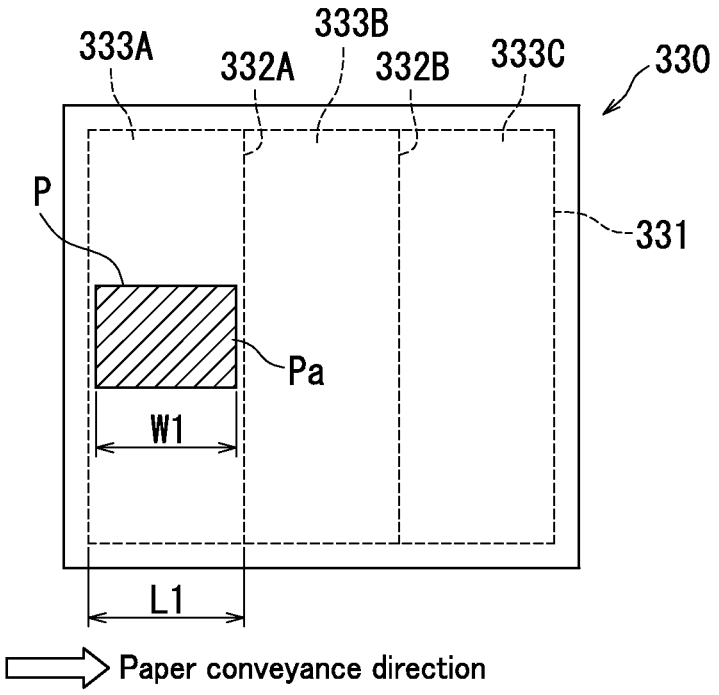
FIG. 3 is an explanatory illustration showing the relationship between a suction unit shown in FIG. 1 and paper.

FIG. 3 is an explanatory illustration showing the relationship between the suction unit 330 of the conveyor device 310 shown in FIG. 1 and paper P. The paper P shown in FIG. 3 has minimum size among paper on which the inkjet recording apparatus 1 is capable of forming an image.

A distance L1 between the partition wall 332A and the partition wall 332B is slightly larger than a length W1 of the paper P in the conveyance direction.

Figure 4:
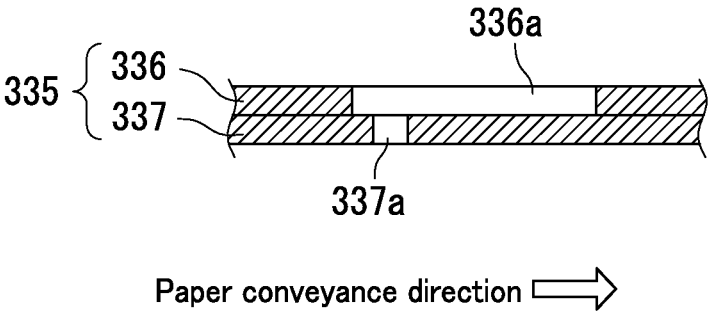
FIG. 4 is a partially enlarged cross sectional view of a ceiling wall shown in FIG. 1.
Figure 5:
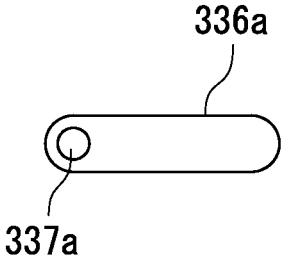
FIG. 5 is a partially enlarged plan view of the ceiling wall shown in FIG. 1.

FIG. 4 is a partially enlarged cross sectional view of the ceiling wall 335 shown in FIG. 1. FIG. 5 is a partially enlarged plan view of the ceiling wall 335 shown in FIG. 1.

As shown in FIG. 4, the ceiling wall 335 is a double wall formed of an upper wall portion 336 and a lower wall portion 337. A plurality of slits 336*a* are formed in the upper wall portion 336, and a plurality of penetration holes 337*a* are formed in the lower wall portion 337 so as to correspond to the plurality of slits 336*a*.

As shown in FIG. 5, the slits 336*a* each have an oval shape extending in the conveyance direction of paper P and penetrate the upper wall portion 336 (see FIG. 4) in the thickness direction.

As shown in FIG. 5, the penetration holes 337*a* each are arranged to face one end part of the respective slits 336*a* and penetrate the lower wall portion 337 (see FIG. 4) in the thickness direction.

Figure 6:
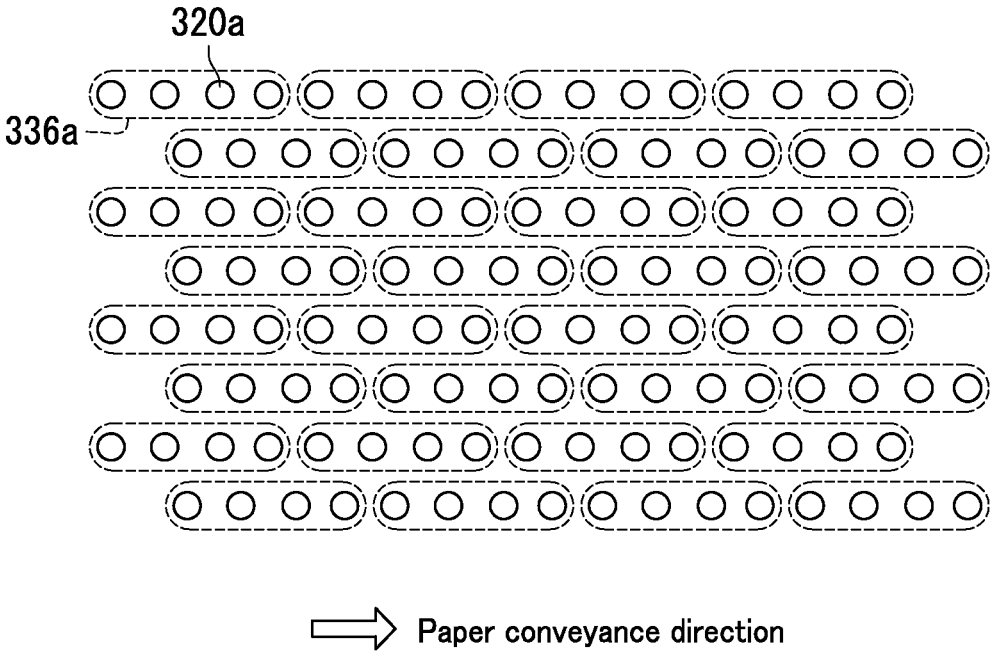
FIG. 6 is an explanatory illustration showing the relationship between suction holes of a conveyance belt and slits of the suction unit shown in FIG. 1.

FIG. 6 is an explanatory illustration showing the relationship between suction holes 320*a* of the conveyance belt 320 and the slits 336*a* of the suction unit 330 shown in FIG. 1.

A plurality of suction holes 320*a* are formed in the conveyance belt 320 to penetrate the conveyance belt 320 in the thickness direction. The suction holes 320*a* are arranged in a plurality of rows in the conveyance direction of paper P in the conveyance belt 320. The rows are arranged in a staggered manner in the width direction of the conveyance belt 320.

The slits 336*a* of the upper wall portion 336 are arranged to correspond to the suction holes 320*a* of the conveyance belt 320. The slits 336*a* are arranged in a plurality of rows in the conveyance direction of paper P in the upper wall portion 336. The rows are arranged in a staggered manner in the width direction of the conveyance belt 320.

Each of the slits 336*a* is formed to face four suction holes 320*a*. Four suction holes 320*a* facing the respective slits 336*a* change in position one by one as the conveyance belt 320 advances.

Each of the cells 333A, 333B, and 333C (see FIG. 2) of the fan case 331 is in constant communication with some of the plurality of suction holes 320*a* of the conveyance belt 320 through the slits 336*a* and the penetration holes 337*a* of the ceiling wall 335 (see FIG. 4).

Figure 7:
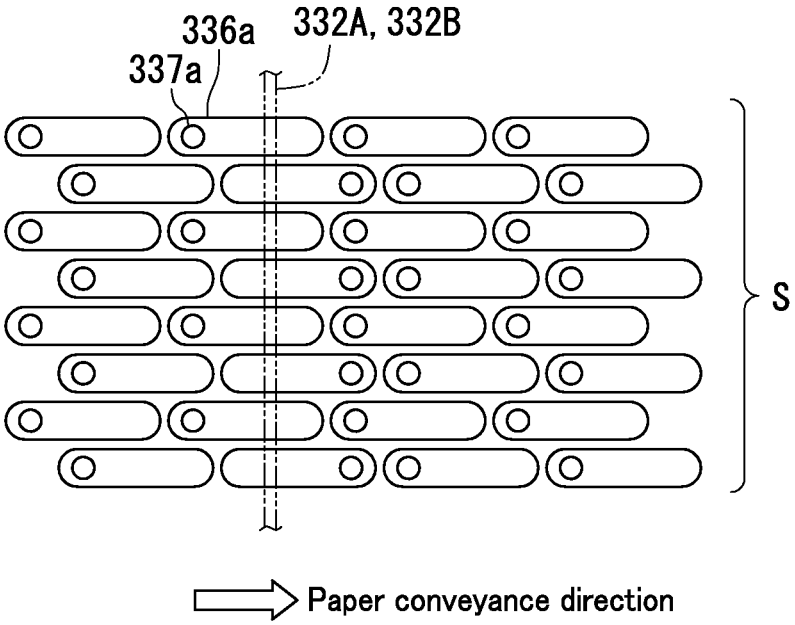
FIG. 7 is an explanatory illustration showing the relationship between the slits and a partition wall.

FIG. 7 is an explanatory illustration showing the relationship between the slits 336*a* and the partition wall 332A or 332B. A slit group S made up of the plurality of slits 336*a* includes a plurality of slits 336*a* formed across the partition wall 332A. Further, the slit group S includes a plurality of slits 336*a* formed across the partition wall 332B.

The slits 336*a* formed across the partition wall 332A include slits 336*a* in communication with one cell 333A of the adjacent cells 333A and 333B through penetration holes 337*a* and slits 336*a* in communication with the other cell 333B through penetration holes 337*a*. The slits 336*a* which are formed across the partition wall 332A and are in communication with the cell 333A and the slits 336*a* which are formed across the partition wall 332A and are in communication with the cell 333B are arranged alternately in the width direction of the conveyance belt 320. With this configuration, a suction force acting on the front end part of the paper P in the conveyance direction can be more uniform in the width direction of the conveyance belt 320 when compared with a configuration without alternate arrangement in the width direction of the conveyance belt 320 between the slits 336*a* communicating with the cell 333A and the slits 336*a* communicating with the cell 333B.

Further, the slits 336*a* formed across the partition wall 332B include slits 336*a* in communication with one cell 333B of the adjacent cells 333B and 333C through penetration holes 337*a* and slits 336*a* in communication with the other cell 333C through penetration holes 337*a*. The slits 336*a* which are formed across the partition wall 332B and are in communication with the cell 333B and the slits 336*a* which are formed across the partition wall 332B and are in communication with the cell 333C are arranged alternately in the width direction of the conveyance belt 320. With this configuration, the suction force acting on the front end part of the paper P in the conveyance direction can be more uniform in the width direction of the conveyance belt 320 when compared with a configuration without alternate arrangement in the width direction of the conveyance belt 320 between the slits 336*a* communicating with the cell 333B and the slits 336*a* communicating with the cell 333C.

Next, operation and advantages of the inkjet recording apparatus 1 in the present embodiment will be described with reference to FIGS. 1-7. Herein, image formation on minimum sized paper on which the inkjet recording apparatus 1 is capable of forming an image will be described.

In FIG. 1, the paper feed roller 202 takes out the uppermost paper P of the plural sheets of paper P accommodated in the paper feed cassette 201 in a layered manner from the paper feed cassette 201. The guide plate 203 guides the paper P to the first conveyance roller pair 402.

The first conveyance roller pair 402 sends out the paper P to the paper conveyance path 401. The second conveyance roller pair 403 conveys the paper P in the conveyance direction of the paper P. Then, the paper P abuts on the registration roller pair 404 and stops for skew correction on the paper P. Then, the paper P is sent out to the image forming section 300 with timing of printing.

The paper P is guided by the paper retention roller 312 onto the conveyance belt 320 and is loaded in the middle of the other surface (upper surface in FIG. 1) of the conveyance belt 320 in the width direction. The paper P covers the suction holes 320*a* (see FIG. 6) formed in the conveyance belt 320 and is sucked on the other surface of the conveyance belt 320 by negative pressure supplied through the suction holes 320*a*. Then, the paper P is conveyed in the conveyance direction as the conveyance belt 320 advances.

The paper P passes above the cells 333A, 333B, and 333C of the fan case 331 in this order (see FIG. 3). This increases the negative pressure in the cells 333A, 333B, and 333C in this order.

For example, as shown in FIG. 3, when the paper P passes above the cell 333A, all or some of the slits 336*a* (see FIG. 6) are closed which overlaps with the suction holes 320 of the conveyance belt 320 covered by the paper P among the plurality of slits 336*a* in communication with the cell 333A. Thus, the negative pressure in the cell 333A increases.

It is noted that the interior of the fan case 331 of the suction unit 330 is partitioned into the cells 333A, 333B, and 333C, and each of the cells 333A, 333B, and 333C is provided with the fan(s) 338 (see FIG. 2). Accordingly, where the number of slits 336*a* (see FIG. 6) covered by paper P is the same, a suction force per unit area applied to the paper P is large when compared with a suction unit of which interior of the fan case 331 is not partitioned into the cells 333A, 333B, and 333C. Thus, the suction force of the suction unit 330 acting on particularly small sized paper (e.g., postcard) can be increased. Also, the small sized paper can be prevented from coming off from the conveyance belt 320.

It is noted that the number of fans 338 provided in the cell 333A located the most upstream in the conveyance direction of the paper P is larger than the number of fans 338 provided in the cell 333B. Accordingly, a suction force per unit area applied to the paper P from the cell 333A is larger than a suction force per unit area applied to the paper P from the cell 333B. Thus, the paper P moving above the cell 333A can be sucked fixedly. Thus, displacement of, for example, the paper P on the conveyance belt 320, which may be caused by the registration roller pair 404 (see FIG. 1) pulling the paper P, can be prevented.

Further, the number of fans 338 provided in the cell 333C located the most downstream in the conveyance direction of the paper P is larger than the number of fans 338 provided in the cell 333B. Accordingly, a suction force per unit area applied to the paper P from the cell 333C is larger than the suction force per unit area applied to the paper P from the cell 333B. Thus, the paper P moving away from the upper surface of the cell 333C can be sucked fixedly. Thus, displacement of, for example, the paper P on the conveyance belt 320, which may be caused by the ejection roller pair 501 (see FIG. 1) pulling the paper P, can be prevented.

Further, the suction unit 330 includes the plurality of slits 336*a* formed across the partition wall 332A or 332B as shown in FIG. 7. With this configuration, an advantage that the front end part of paper P in the conveyance direction can be prevented from coming off can be gained as will be described specifically later.

In order to promote understanding of the advantage, a problem of a suction unit in a comparative example will be described. The suction unit in the comparative example does not include the slits 336*a* formed across the partition wall 332A or 332B. The other configuration thereof is the same as that of the suction unit 330.

Figure 8:
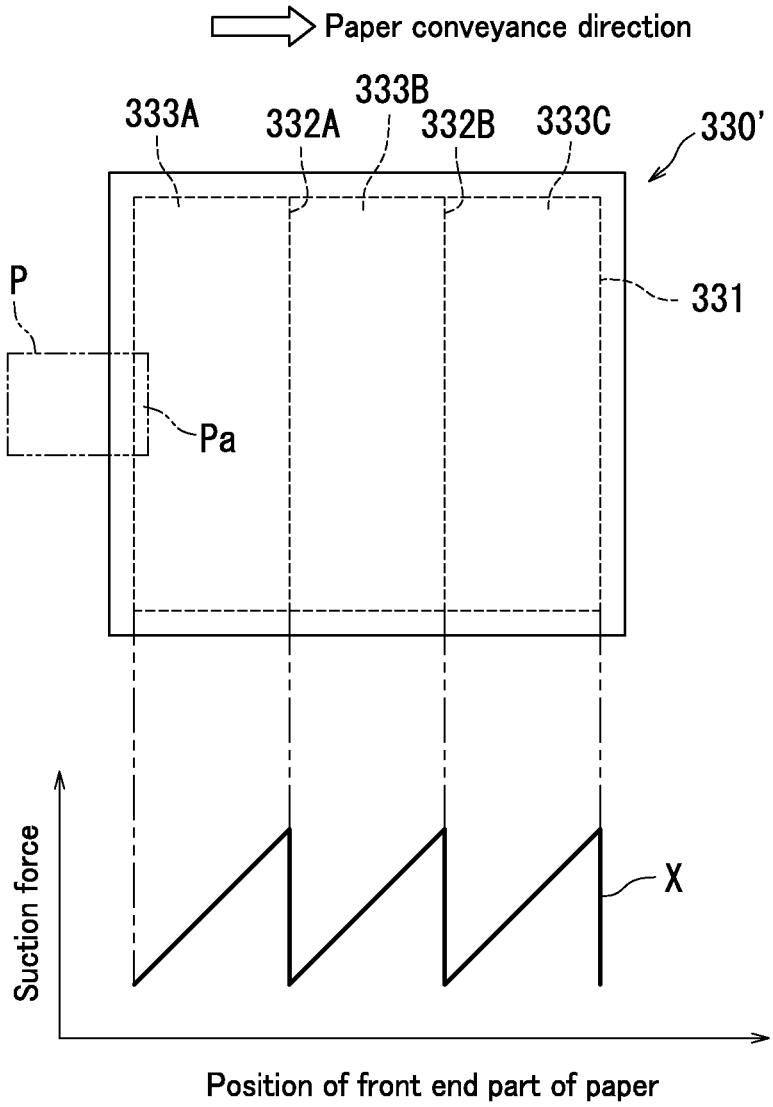
FIG. 8 is an illustration for explaining a problem of a suction unit in a comparative example.
Figure 9:
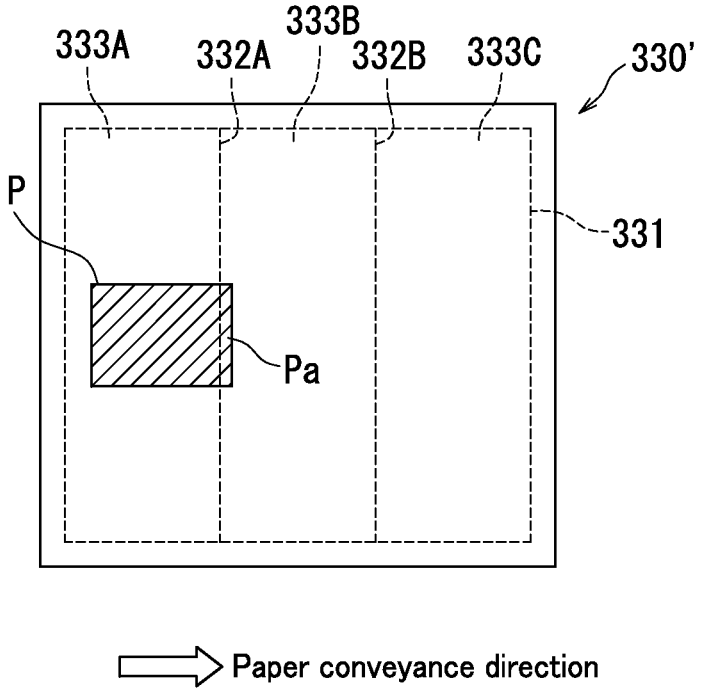
FIG. 9 is an illustration showing a state in which a front end part of paper in a conveyance direction has moved across a partition wall of the suction unit in the comparative example.

FIG. 8 is an illustration for explaining a problem of a suction unit 330' in the comparative example. FIG. 9 is an illustration showing a state in which a front end part Pa of paper P in the conveyance direction has moved across the partition wall 332A of the suction unit 330' in the comparative example.

In FIG. 8, a line X is a graph showing the relationship between the position of the front end part Pa of paper P in the conveyance direction and a suction force to the front end part Pa. The axis of abscissa indicates the position of the front end part Pa of the paper P, and the axis of ordinate indicates the magnitude of the suction force to the front end part Pa of the paper P. When the front end part Pa of the paper P moves above the cell 333A to overlap with some of the plurality of slits 336*a* (see FIG. 7) in communication with the cell 333A, a suction force to the front end part Pa of the paper P is generated. Then, the negative pressure in the cell 333A gradually increases since the area of the slits 336*a* overlapping with the paper P increases as the paper P advances in the conveyance direction. Thus, the suction force to the front end part Pa of the paper P increases to reach a maximum immediately before the front end part Pa of the paper P reaches the partition wall 332A.

Then, as shown in FIG. 9, at that moment when the front end part Pa of the paper P moves across the partition wall 332A, the suction force to the front end part Pa of the paper P abruptly decreases, as shown in FIG. 8, since the front end part Pa of the paper P overlaps with none of the plurality of slits 336*a* in communication with the cell 333B. Thereafter, the suction force to the front end part Pa of the paper P gradually increases as the paper P advances in the conveyance direction.

As described above, when the front end part Pa of the paper P moves across the partition wall 332A or 332B, the suction force to the front end part Pa of the paper P abruptly decreases, so that the suction force to the front end part Pa of the paper P does not increase instantly. Thus, the front end part Pa of the paper P can tend to come off from the other surface of the conveyance belt 320.

In contrast, since the suction unit 330 in the present disclosure includes the plurality of slits 336*a* formed across the partition wall 332A or 332B, the suction force is kept acting on the front end part Pa (see FIG. 9) of paper P even when the front end part Pa of the paper P moves across the partition wall 332A or 332B, as shown in FIG. 7. Thus, the front end part Pa of the paper P can be prevented from coming off from the other surface of the conveyance belt 320.

Figure 10:
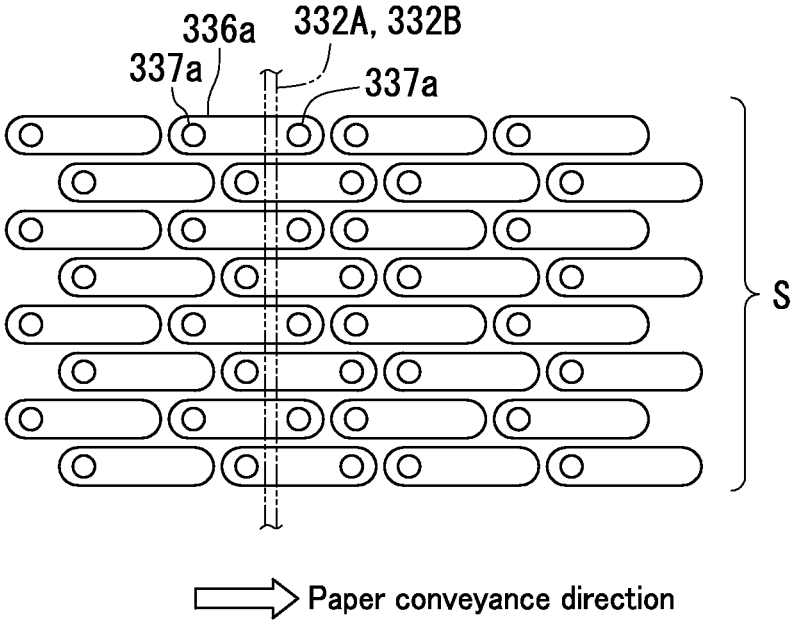
FIG. 10 is an illustration showing a suction unit of a conveyor device according to the second embodiment of the present disclosure.

Next, the second embodiment of the present disclosure will be described. FIG. 10 shows a suction unit of a conveyor device according to the second embodiment of the present disclosure. The relationship between slits of the suction unit in the second embodiment and a partition wall will be described with reference to FIG. 10. It is noted that elements corresponding to those in the first embodiment are denoted with like numerals in the first embodiment, and duplicate description is omitted.

As shown in FIG. 10, in the present embodiment, a plurality of slits 336*a* formed across a partition wall 332A each are in communication with a cell 333A and a cell 333B, which are arranged adjacent to each other in a conveyance direction of paper P, through penetration holes 337*a* in communication with the cell 333A and penetration holes 337*a* in communication with the cell 333B.

Further, a plurality of slits 336*a* formed across the partition wall 332B each are in communication with the cell 333B and a cell 333C, which are arranged adjacent to each other, in the conveyance direction of the paper P, through penetration holes 337*a* in communication with the cell 333B and penetration holes 337*a* in communication with the cell 333C.

According to the present embodiment, the suction force is kept acting on the front end part Pa (see FIG. 9) of the paper P even when the front end part Pa of the paper P moves across the partition wall 332A or 332B. Thus, the front end part Pa of the paper P can be prevented from coming off from the other surface of the conveyance belt 320.

Further, in the present embodiment, negative force from the two cells acts on each of the plurality of slits 336*a* formed across the partition wall 332A or 332B. Thus, according to the present embodiment, the front end part Pa of the paper P can be sucked fixedly. This can reliably prevent the front end part Pa of the paper P from coming off from the other surface of the conveyance belt 320.

The specific embodiments of the present disclosure have been described above. However, the present disclosure is not limited to the above described embodiments. Various types of alteration are applicable to the above described embodiments.

The fan is used as a suction section in the above described embodiments. However, any other suction section (e.g., vacuum pump) can be employed, for example. Further, the suction section is provided in the interior of each cell in the above embodiment, but may be provided external to the cells.

Further, in the above described embodiments, three cells are formed and defined in the interior of the unit case. However, two, four or more cells may be formed and defined in the interior of the unit case.

Further, in the above described embodiments, the case in which the present disclosure is applied to an inkjet recording apparatus including a line type recording head has been described. However, the present disclosure may be applicable to an inkjet recording apparatus including a serial type recording head.

Furthermore, in the above described embodiments, the case in which the present disclosure is applied to an inkjet recording apparatus has been described. However, the present disclosure is applicable also to any other image forming apparatuses (e.g., electrophotographic image forming apparatuses).

In addition, in the above described embodiments, the case in which the recording medium is paper has been described. However, recording mediums other than the paper may be used, such as resin sheets and cloth.

Besides, various types of alteration are applicable to the above described embodiments within the scope not departing from the subject matter of the present disclosure.

What is claimed is:

1. A conveyor device which conveys a recording medium, comprising:

a conveyance belt in which a plurality of suction holes are formed and which is driven in a conveyance direction of the recording medium; and a suction unit arranged on one of surfaces of the conveyance belt and configured to suck the recording medium on the other surface of the conveyance belt through the plurality of suction holes, wherein the suction unit includes:

a unit case in which cells adjacent in the conveyance direction of the recording medium are formed and defined by a partition wall extending in a width direction of the conveyance belt;

a ceiling wall interposed between the unit case and the conveyance belt; and a suction section provided in each of the adjacent cells and configured to generate negative pressure in an interior of the corresponding cell, wherein respective suction forces per unit area applied to the recording medium in any two adjacent cells, are different from each other;

the ceiling wall includes a slit group which communicates the respective adjacent cells with the plurality of suction holes, the slit group includes a plurality of slits formed across the partition wall, and the plurality of slits include slits in communication with one of the adjacent cells and slits in communication with the other of the adjacent cells.

2. A conveyor device according to claim 1, wherein each of the plurality of slits is in communication with each of the adjacent cells.

3. A conveyor device according to claim 1, wherein the suction section includes a fan.

4. A conveyor device according to claim 1, wherein three or more cells are formed and defined in an interior of the unit case, and the three or more cells include a cell located the most upstream in the conveyance direction of the recording medium, a cell located the most downstream in the conveyance direction of the recording medium, and a cell located between the cell located the most upstream and the cell located the most downstream, and respective suction forces per unit area applied to the recording medium from the cell located the most upstream and the cell located the most downstream are larger than a suction force per unit area applied to the recording medium from the cell located between the cell located the most upstream and the cell located the most downstream.

5. A conveyor device according to claim 1, wherein three or more cells are formed and defined in an interior of the unit case, and the three or more cells include a cell located the most upstream in the conveyance direction of the recording medium, a cell located the most downstream in the conveyance direction of the recording medium, and a cell located between the cell located the most upstream and the cell located the most downstream, and a suction force per unit area applied to the recording medium from the cell located the most upstream is larger than a suction force per unit area applied to the recording medium from the cell located between the cell located the most upstream and the cell located the most downstream.

6. A conveyor device according to claim 1, wherein three or more cells are formed and defined in an interior of the unit case, and the three or more cells include a cell located the most upstream in the conveyance direction of the recording medium, a cell located the most downstream in the conveyance direction of the recording medium, and a cell located between the cell located the most upstream and the cell located the most downstream, and a suction force per unit area applied to the recording medium from the cell located the most downstream is larger than a suction force per unit area applied to the recording medium from the cell located between the cell located the most upstream and the cell located the most downstream.

7. A conveyor device according to claim 1, wherein the slits in communication with the one of the adjacent cells and the slits in communication with the other of the adjacent cells are arranged alternately in the width direction of the conveyance belt.

8. A conveyor device according to claim 1, wherein the ceiling wall covers each of the adjacent cells formed and defined by the partition wall.

9. An image forming apparatus, comprising:

a conveyor device configured to convey a recording medium; and an image forming section configured to form an image on the recording medium, wherein the conveyor device includes:

a conveyance belt in which a plurality of suction holes are formed and which is driven in a conveyance direction of the recording medium; and a suction unit arranged on one of surfaces of the conveyance belt and configured to suck the recording medium on the other surface of the conveyance belt through the plurality of suction holes, the suction unit includes:

a unit case in which cells adjacent in the conveyance direction of the recording medium are formed and defined by a partition wall extending in a width direction of the conveyance belt;

a ceiling wall interposed between the unit case and the conveyance belt; and a suction section provided in each of the adjacent cells and configured to generate negative pressure in an interior of the corresponding cell, wherein respective suction forces per unit area applied to the recording medium in any two adjacent cells, are different from each other;

the ceiling wall includes a slit group which communicates the respective adjacent cells with the plurality of suction holes, the slit group includes a plurality of slits formed across the partition wall, and the plurality of slits include slits in communication with one of the adjacent cells and slits in communication with the other of the adjacent cells.

10. An image forming apparatus according to claim 9, wherein each of the plurality of slits is in communication with each of the adjacent cells.

11. An image forming apparatus according to claim 9, wherein the suction section includes a fan.

12. An image forming apparatus according to claim 9, wherein three or more cells are formed and defined in an interior of the unit case, and the three or more cells include a cell located the most upstream in the conveyance direction of the recording medium, a cell located the most downstream in the conveyance direction of the recording medium, and a cell located between the cell located the most upstream and the cell located the most downstream, and respective suction forces per unit area applied to the recording medium from the cell located the most upstream and the cell located the most downstream are larger than a suction force per unit area applied to the recording medium from the cell located between the cell located the most upstream and the cell located the most downstream.

13. An image forming apparatus according to claim 9, wherein three or more cells are formed and defined in an interior of the unit case, and the three or more cells include a cell located the most upstream in the conveyance direction of the recording medium, a cell located the most downstream in the conveyance direction of the recording medium, and a cell located between the cell located the most upstream and the cell located the most downstream, and a suction force per unit area applied to the recording medium from the cell located the most upstream is larger than a suction force per unit area applied to the recording medium from the cell located between the cell located the most upstream and the cell located the most downstream.

14. An image forming apparatus according to claim 9, wherein three or more cells are formed and defined in an interior of the unit case, and the three or more cells include a cell located the most upstream in the conveyance direction of the recording medium, a cell located the most downstream in the conveyance direction of the recording medium, and a cell located between the cell located the most upstream and the cell located the most downstream, and a suction force per unit area applied to the recording medium from the cell located the most downstream is larger than a suction force per unit area applied to the recording medium from the cell located between the cell located the most upstream and the cell located the most downstream.

15. An image forming apparatus according to claim 9, wherein the slits in communication with the one of the adjacent cells and the slits in communication with the other of the adjacent cells are arranged alternately in the width direction of the conveyance belt.

16. An image forming apparatus according to claim 9, wherein the image forming section employs an inkjet recording method.

17. An image forming apparatus according to claim 9, wherein the ceiling wall covers each of the adjacent cells formed and defined by the partition wall.

* * * * *